US009957148B2

(12) United States Patent
Murray

(10) Patent No.: US 9,957,148 B2
(45) Date of Patent: May 1, 2018

(54) POUCH WITH A TUBE SPOUT FITMENT

(71) Applicant: Pouch Pac Innovations, LLC, Sarasota, FL (US)

(72) Inventor: R. Charles Murray, Sarasota, FL (US)

(73) Assignee: Pouch Pac Innovations, LLC, Sarasota, FL (US)

( * ) Notice: Subject to any disclaimer, the term of this patent is extended or adjusted under 35 U.S.C. 154(b) by 80 days.

(21) Appl. No.: 14/280,809

(22) Filed: May 19, 2014

(65) Prior Publication Data

US 2014/0246455 A1 Sep. 4, 2014

Related U.S. Application Data

(63) Continuation-in-part of application No. 12/881,908, filed on Sep. 14, 2010, now Pat. No. 8,745,836.
(Continued)

(51) Int. Cl.
*B65B 61/18* (2006.01)
*B65B 3/04* (2006.01)
(Continued)

(52) U.S. Cl.
CPC ..... *B67D 3/0067* (2013.01); *B65B 3/045* (2013.01); *B65D 75/5877* (2013.01);
(Continued)

(58) Field of Classification Search
CPC ..... B67D 3/0067; B65B 3/045; B65B 3/17; B65B 7/025; B65B 1/18; B65B 43/262; B65B 43/40; B65B 61/186; B65D 75/5877; B65D 41/0471; B65D 47/0814; B65D 41/0421; B65D 47/10; B65D 75/58; B65D 37/00; Y10T 29/4987; Y10T 29/49872; Y10T 29/49879; Y10T 29/49945; Y10T 29/49947; B31B 19/84; B31B 2219/9054; B31B 2221/20; B31B 2221/102
See application file for complete search history.

(56) References Cited

U.S. PATENT DOCUMENTS 2,286,263 A * 6/1942 Comins ..... F16L 37/113 285/334.3
3,168,969 A * 2/1965 Krieps ..... B65D 47/242 222/520
(Continued)

*Primary Examiner* — Ryan J Walters
*Assistant Examiner* — Lawrence Averick
(74) *Attorney, Agent, or Firm* — Dinsmore & Shohl LLP

(57) ABSTRACT

A flexible pouch with a tube spout fitment and removable cap. The flexible pouch has a panel with an aperture and a tube spout fitment that extends through the aperture. The tube spout fitment has a first circumferential ridge with a first diameter and a second circumferential ridge with a second diameter. Also, the second diameter is larger than the first diameter. A dispensing cap is attached to the tube spout fitment. The dispensing cap has a first temporary snap position fitting over the first circumferential ridge of the tube spout fitment and a second permanent snap position fitting over the second circumferential ridge. In this manner, the dispensing cap can be temporarily attached to the pouch during storage, shipping and the like, removed prior to filling the flexible pouch with product, and then permanently attached after the pouch has been filled with product.

10 Claims, 4 Drawing Sheets

Related U.S. Application Data

(60) Provisional application No. 61/242,059, filed on Sep. 14, 2009.

(51) Int. Cl.

| | |
|---|---|
| ***B67D 3/00*** | (2006.01) |
| ***B65D 75/58*** | (2006.01) |
| *B31B 150/00* | (2017.01) |
| *B31B 160/20* | (2017.01) |
| *B31B 70/84* | (2017.01) |
| *B31B 160/10* | (2017.01) |

(52) U.S. Cl.

CPC ..... *B31B 70/844* (2017.08); *B31B 2150/00* (2017.08); *B31B 2160/102* (2017.08); *B31B 2160/20* (2017.08)

(56) References Cited

U.S. PATENT DOCUMENTS 3,454,196 A * 7/1969 Hazard ..... B65D 47/123 222/541.2
4,129,236 A * 12/1978 Wrycraft ..... B65D 47/14 220/320
4,286,636 A * 9/1981 Credle ..... B65D 83/0055 138/115
4,445,539 A * 5/1984 Credle ..... B65D 83/0055 137/614.03
4,445,550 A * 5/1984 Davis ..... B65D 37/00 141/329
5,445,186 A * 8/1995 Richter ..... B65D 47/2075 137/614.03
5,477,883 A * 12/1995 Totten ..... B65D 77/067 137/614.03
5,609,195 A * 3/1997 Stricklin ..... F16L 37/28 137/614.04
5,709,244 A * 1/1998 Patriquin ..... F16L 37/30 137/614.04
5,816,298 A * 10/1998 Stricklin ..... F16L 41/16 137/614.04
6,131,767 A * 10/2000 Savage ..... B67D 3/043 222/1
6,170,543 B1 * 1/2001 Simmel ..... B67D 7/0294 141/346
6,290,124 B2 * 9/2001 Andrews, Sr. ..... B65D 77/065 229/117.15
6,296,157 B1 * 10/2001 Erb ..... B67D 3/044 222/509
6,607,097 B2 * 8/2003 Savage ..... B65D 75/5877 220/62.12
6,612,545 B1 * 9/2003 Rutter ..... B65D 77/067 141/346
6,637,725 B2 * 10/2003 Davis ..... B67D 1/0835 137/269
6,702,337 B2 * 3/2004 Rutter ..... B65D 77/067 285/362
6,851,579 B2 * 2/2005 Savage ..... B65D 75/5877 220/62.12
6,883,683 B1 * 4/2005 Cunningham ..... B65D 75/58 222/107
6,893,000 B2 * 5/2005 Rutter ..... F16L 41/02 141/346
7,357,276 B2 * 4/2008 Savage ..... B65D 75/5877 222/92
7,357,277 B2 * 4/2008 Verespej ..... B65D 47/0814 222/153.01
7,380,575 B2 * 6/2008 Stricklin ..... B65B 3/045 141/10
7,387,220 B2 * 6/2008 Verespej ..... B65D 47/0814 220/254.1
7,487,951 B2 * 2/2009 Johnson ..... B65D 77/067 141/349
D607,090 S * 12/2009 Johnson ..... D23/262
7,628,299 B2 * 12/2009 Johnson ..... B65D 77/065 141/346
D618,763 S * 6/2010 Johnson ..... B67D 1/0082 D23/237
7,832,576 B2 * 11/2010 Cohn ..... A61J 9/005 215/11.1
D641,832 S * 7/2011 Johnson ..... D23/237
7,980,424 B2 * 7/2011 Johnson ..... B65D 75/5877 222/105
8,104,644 B2 * 1/2012 Py ..... B65B 39/004 222/1
8,196,621 B2 * 6/2012 Johnson ..... B67D 1/0082 141/372
9,499,314 B2 * 11/2016 Fan ..... B65D 47/06
9,573,736 B2 * 2/2017 Arch ..... B65D 47/068
9,624,005 B2 * 4/2017 Pereira ..... B65D 33/16
2002/0094923 A1 * 7/2002 Edwards ..... B65D 31/005 493/221
2003/0026508 A1 * 2/2003 Smith ..... B65D 41/0421 383/80
2004/0065056 A1 * 4/2004 Wilford ..... B65B 61/186 53/469
2004/0232374 A1 * 11/2004 Rutter ..... F16L 41/02 251/149.6
2004/0256424 A1 * 12/2004 Johnson ..... B65D 77/067 222/518
2005/0025398 A1 * 2/2005 Edwards ..... B31B 19/00 383/104
2005/0139565 A1 * 6/2005 Cohn ..... A61J 9/005 215/11.1
2006/0110077 A1 * 5/2006 Savage ..... B65D 75/5877 383/66
2007/0012644 A1 * 1/2007 Uytterhaeghe ..... B65D 47/10 215/48
2007/0160785 A1 * 7/2007 Hsu ..... B32B 27/08 428/35.2
2007/0181578 A1 * 8/2007 Johnson ..... B65D 41/0471 220/258.3
2008/0226200 A1 * 9/2008 Murray ..... B65B 3/045 383/7
2008/0245817 A1 * 10/2008 Bellmore ..... B65D 75/5877 222/107
2008/0247682 A1 * 10/2008 Murray ..... B65B 3/02 383/104
2009/0028470 A1 * 1/2009 Murray ..... B65D 75/5883 383/80
2009/0255626 A1 * 10/2009 Murray ..... B65B 61/186 156/253
2010/0133273 A1 * 6/2010 Thurman ..... B65D 47/0838 220/260
2011/0061222 A1 * 3/2011 Murray ..... B31B 19/00 29/426.2
2011/0152051 A1 * 6/2011 Murray ..... B65B 3/04 493/213
2011/0240587 A1 * 10/2011 Cohn ..... A61J 9/005 215/11.3
2015/0150762 A1 * 6/2015 Cohn ..... A61J 9/005 215/11.3
2016/0009462 A1 * 1/2016 Erickson ..... B65D 25/48 222/545
2016/0107807 A1 * 4/2016 Fan ..... B65D 47/06 222/92
2016/0122104 A1 * 5/2016 Bellmore ..... B65D 75/5877 222/566

* cited by examiner

POUCH WITH A TUBE SPOUT FITMENT

CROSS-REFERENCE TO RELATED APPLICATIONS

This application is a continuation-in-part (CIP) of U.S. patent application Ser. No. 12/881,908, filed on Sep. 14, 2010, which in turn claims priority of U.S. Provisional Patent Application Ser. No. 61/242,059 filed Sep. 14, 2009, both of which are incorporated herein in their entirety by reference.

FIELD OF THE INVENTION

The present invention relates generally to a flexible pouch with a tube spout fitment, and in particular, to a process for making the flexible pouch with the tube spout fitment.

BACKGROUND OF THE INVENTION

Flexible pouches with and without a tube spout fitment and a dispensing cap are known. Most pouches with tube spout fitments commonly include the fitment within a seam along a side edge of the pouch. Location of the fitment within the seam can facilitate the manufacturing process since the tube spout fitment can be positioned along a side edge of a sheet and the sheet folded onto the fitment and sealed thereto. However, such pouches must be physically manipulated so as to drain the contents of the pouch through the spout fitment. As such, it would be desirable to have a pouch with the tube spout fitment located along or within the body of the pouch so as to dispense contents of the pouch using gravity.

Installing the tube spout fitment along the body of the pouch requires precision. In particular, the tube spout fitment must be precisely placed within an aperture formed in a pouch panel with failure resulting in an improper seal between the panel and the fitment. As such, it would be desirable to have a process for installing the tube spout fitment that is cost effective and yet precise with respect to placing the fitment within the aperture.

In addition to the above, distribution of flexible pouches with a tube spout fitment is often performed by packaging a plurality of pouches into a shipping container and transporting the container to a location where the pouches are filled with a product. However, once the dispensing cap is placed on or attached to the tube spout fitment, the cap can be difficult to remove from the fitment in order to allow filling of the pouch. As such, tube spout fitment-type pouches are often package and transported without, or before, the dispensing cap is attached to the fitment. Although packaging and transportation in this manner solves the problem of removing the dispensing cap from the tube spout fitment, the absence of the cap can allow dust, dirt, etc., to enter the interior of the pouch through the fitment. Therefore, a process and/or tube spout fitment-dispensing cap combination that prevents such contamination of the interior of the pouch during shipping would be desirable.

SUMMARY OF THE INVENTION

A process for placing a tube spout fitment within a flexible pouch container is provided. The process can include providing a front panel with an aperture and a back panel, each panel having a top edge, a side edge, and a bottom edge. The process includes sealing the side edges together to form a side seam and providing a plate that has a channel and a channel stop. A fitment having a fitment base and a spout extending from the fitment base is provided and the fitment base is dimensioned to fit at least partially within the channel of the plate and yet not be able to pass through the aperture of the front panel.

The base of the fitment is placed at least partially within the channel of the plate such that it abuts against the channel stop, the channel stop affording positioning of the fitment at a desired location on the plate. In addition, the bottom edges of the front and back panels are opened and/or spaced apart from each other and the plate with the fitment is slid between the bottom edges of the front and back panels until the spout is aligned with the aperture of the front panel. The front panel is then placed over the spout, e.g. by lowering, pushing, and/or vacuum, such that the spout extends through the aperture. The plate can then be removed from between the front and back panels leaving the spout within or extending through the aperture and the fitment base located between the front and back panels. It is appreciated that the plate is dimensioned to slide between the front and back panels such that the channel holds the fitment at a location such that it aligns with the aperture in the front panel.

In some instances, the front panel and the back panel each have a pair of side edges, the pair of side edges sealed together to form a pair of side seams. The plate can be dimensioned to slide between the pair of side seams. In addition, the top edges of the front and back panels can be sealed together before, during or after sliding of the plate with the fitment between the bottom edges of the panels. The top seam may or may not have one or more finger apertures for grasping the flexible pouch container. The finger aperture(s) have a perimeter edge and the edge that may or may not have a scalloped outline/shape.

The aperture of the front panel has a perimeter that can be sealed to the fitment base to form a fitment base seam. In addition the bottom edges of the front panel and the back panel can be sealed together to form a bottom seam, and thus provide a flexible pouch container having a tube spout fitment sealed thereto. It is appreciated that such a flexible pouch container can be filled with a product through the fitment.

A dispensing cap can further be provided and be dimensioned to snap onto the spout and be attached thereto. The spout extending through the aperture of the front panel can have a first circumferential ridge proximate a spout end and a second circumferential ridge proximate the fitment base. The dispensing cap can have a first snap position fitting over the first circumferential ridge and a second snap position fitting over the second circumferential ridge. In addition, the first snap position can form a temporary attachment of the dispensing cap onto the spout and the second snap position can form a permanent attachment of the cap onto the spout. Stated differently, the second circumferential ridge can be a lock portion of the spout that when engaged provides permanent attachment of the cap onto the spout.

In some instances, an automated gripper can place the fitment base at least partially within the channel of the plate such that the base abuts the channel stop. In addition, the same or a different automated gripper can slide the plate and the fitment between the bottom edges of the front and back panels until the spout is aligned with the aperture of the front panel. The automated gripper can then remove the plate from between the front and back panels after the front panel has been placed over the spout, the spout extending through the aperture, thereby leaving the fitment base between the front and back panels and the spout extending outwardly through the front panel.

A gusset having at least a pair of edges can be included between the front and back panels. The gusset edges can be sealed to the top, side and/or bottom edges of the front and back panels. The bottom edge of the front panel and a respective or appropriate gusset edge can remain unsealed until after the spout of the fitment has been placed within the aperture and the plate removed from between the front and back panels.

The dispensing cap can be temporarily attached to the spout of the fitment by forcing the cap over the first circumferential ridge. In this manner, the dispensing cap can prevent dust, dirt, etc. from entering the interior of the flexible pouch during shipping, storage, etc. Upon arrival at a filling location, the dispensing cap can be removed from its temporary position/attachment and the flexible pouch filled with a product through the tube spout fitment. Thereafter, the dispensing cap can be permanently attached to the tube spout fitment by pushing and/or locating the cap over the first and second circumferential ridges of the spout. It is appreciated that the permanent attachment of the cap on the spout can afford for a gas- and/or liquid-tight seal for the flexible pouch.

DETAILED DESCRIPTION OF THE INVENTION

The present invention discloses a process for placing a tube spout fitment within a flexible pouch container. As such, the present invention has utility as a process for making a flexible pouch.

The process includes providing a flexible pouch container that has a pair of oppositely disposed bottom edges that can be opened or spaced apart from each other. In addition, a plate that has a groove or channel that a tube spout fitment can be seated at least partially within is included. The plate with the channel can have a channel stop that the tube spout fitment can abut up against. The plate with the tube spout fitment can slide between the opened bottom edges of the front and back panels such that the tube spout fitment is located directly under or in alignment with an aperture in the front panel. Thereafter, the front panel can be placed over a spout portion of the fitment and the plate can be removed between the front and back panels with the fitment remaining behind, i.e. the spout portion extending through the aperture and a fitment base remaining between the front and back panels.

The fitment base can fit at least partially within the channel of the plate and yet not fit through the aperture of the front panel. In addition, the aperture has a perimeter and/or perimeter region that can be sealed to the fitment base.

In some instances, a robotic arm and/or automated gripper can grasp the plate and place and/or align the fitment relative to the aperture of the front panel. In this manner, placement of the tube spout fitment between front and back panels of the flexible pouch container can incorporate as part of an automated flexible pouch manufacturing machine and/or process.

A gusset can be placed at least partially between the front panel and the second panel such that a generally flat bottomed container with a tube spout fitment located proximate to a bottom region of the container is provided. The flexible pouch container can have one or more finger apertures that afford for an individual to grasp the container, the finger apertures having a generally circular shape, elongated shape, and the like. In addition, the finger apertures may or may not have a scalloped outline or shape that can aid in grasping the pouch, carrying of the pouch, and the like.

Figure 1:
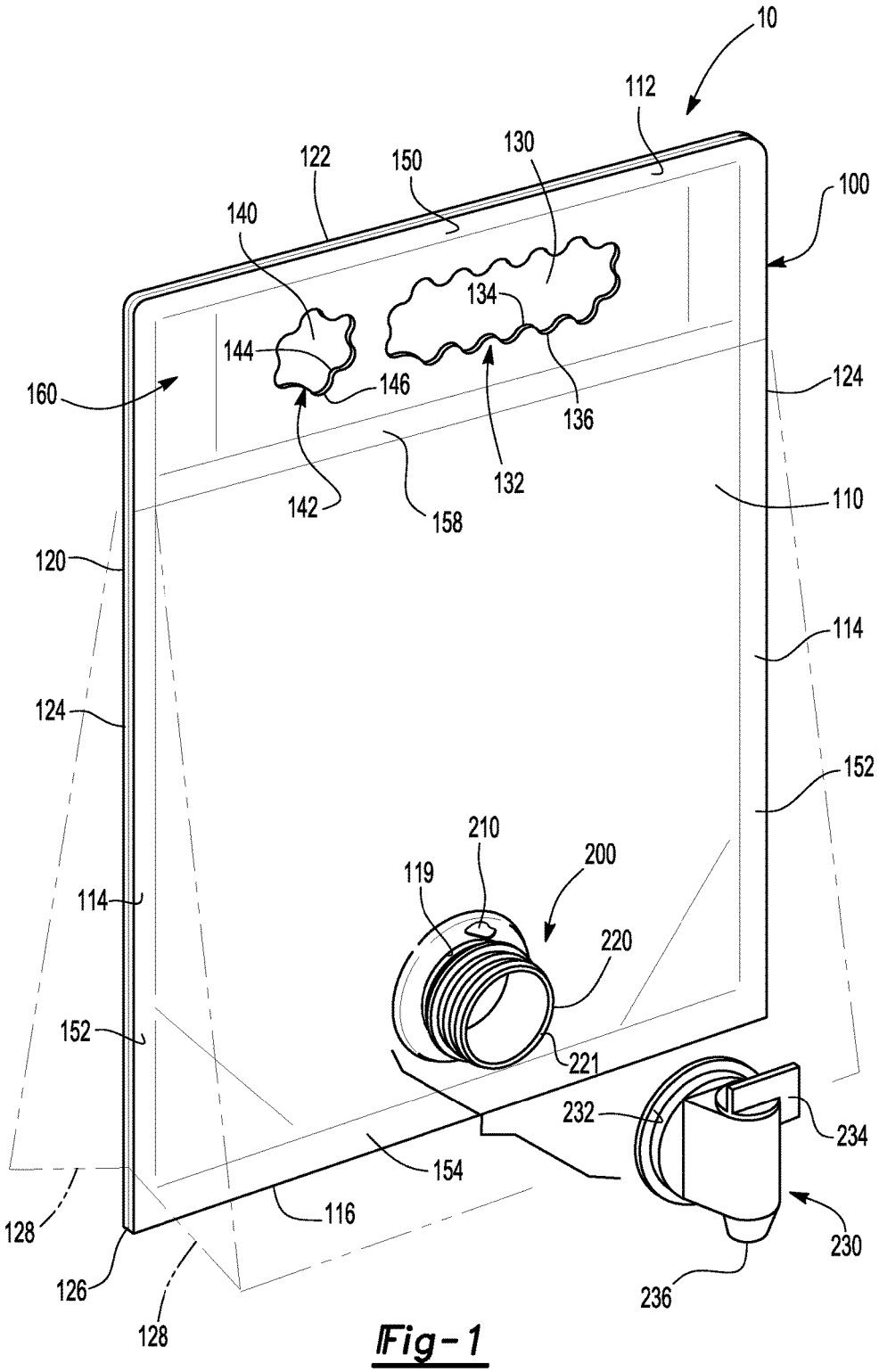
FIG. 1 is a perspective view of a flexible pouch container with a tube spout fitment according to an embodiment of the present invention.

Turning now to the figures, FIG. 1 illustrates a perspective view of a flexible pouch container 10 according to an embodiment of the present invention. The container 10 can have a pouch body 100 that includes a front panel 110 and a back panel 120. The front panel 110 can have a top edge 112, a side edge 114, and a bottom edge 116. Similarly, the back panel 120 can have a top edge 122, a side edge 124, and a bottom edge 126. The edges of the front panel and the back panel can be sealed together using any device, system, process, etc., known to those skilled in the art to form a top seam 150, a side seam 152 and a bottom seam 154. In some instances, a gusset 128 can be included between the front panel 110 and the bottom panel 120 as known to those skilled in the art. The gusset 128 affords for greater volume to be located between the front panel 110 and the back panel 120. It is appreciated that the gusset 128 can be sealed to the top edges, side edges, and/or bottom edges of the front panel 110 and/or bottom panel 120.

Figure 2:
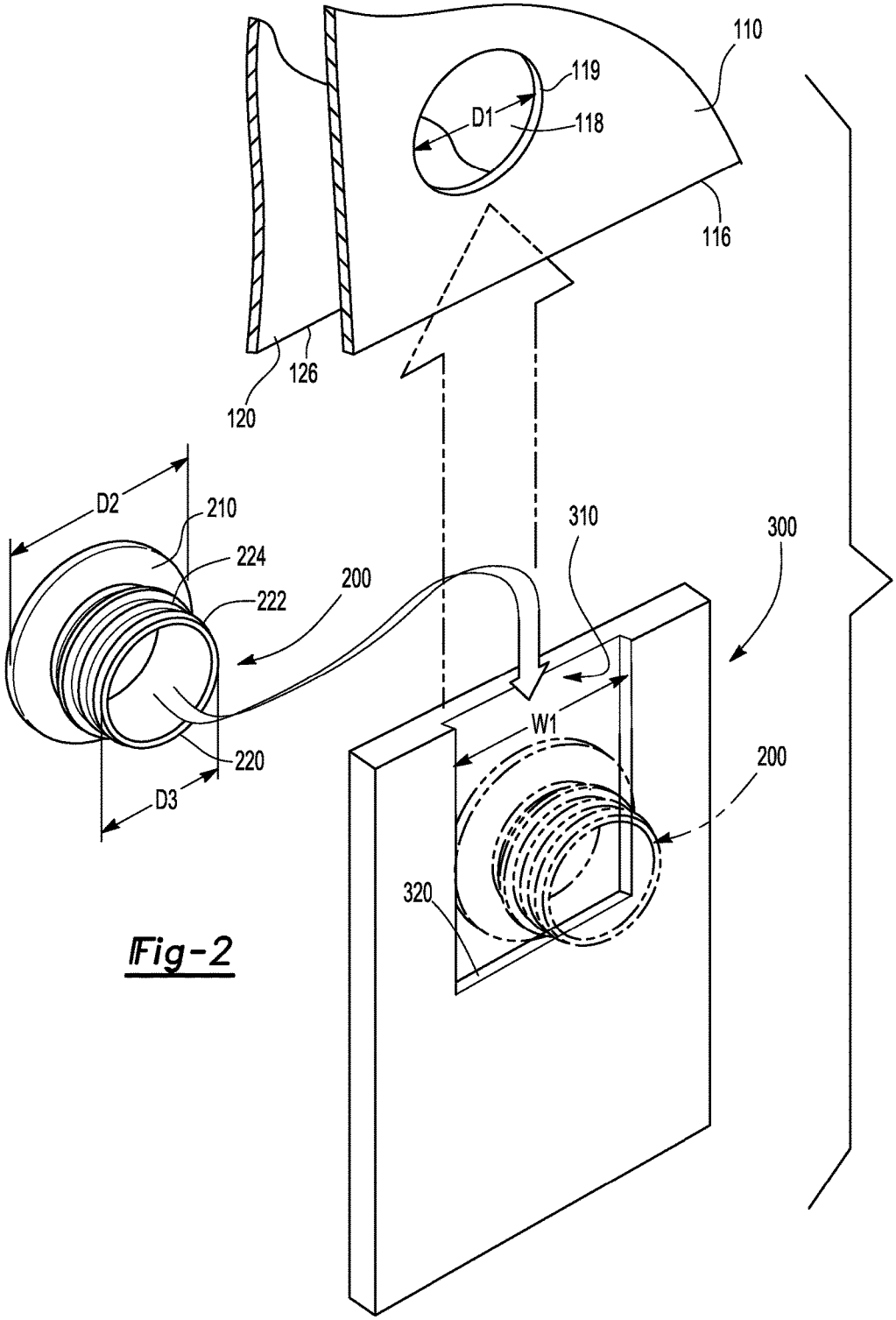
FIG. 2 is a perspective view of a plate used to place the tube spout fitment at a precise location relative to the flexible pouch shown in FIG. 1.

Referring to FIG. 2, the front panel 110 can have an aperture 118, the aperture 118 having a perimeter 119. In addition, a tube spout fitment 200 having a base 210 and a spout 220 with a distal end 221 can be provided and sealed to the front panel 110, thereby providing an opening for filling and/or dispensing of product from the pouch 10. As illustrated in FIG. 2, a plate 300 having a channel 310 and a channel stop 320 affords for the tube spout fitment 200 and/or the base 210 to be located at least partially within the channel 310. The plate 300 with the fitment 200 can be slid between the front panel 110 and the back panel 120 until the fitment 200 located in a desired position relative to the aperture 118. In the alternative, the back panel 120 can be replaced with a portion of the gusset 128 and the plate 300 with the fitment 200 can be slid between the front panel 110 and the portion of the gusset 128 until the fitment 200 located in a desired position relative to the aperture 118.

The aperture 118 can have a diameter D1 and the base 210 of the fitment 200 can have a diameter D2 that is greater than D1 while the spout 220 has a diameter D3 that is less than D1. In this manner, the spout portion 220 can fit through the aperture 118 while the base 210 cannot. The diameter D2 of base 210 can also be slightly less than a width W1 of the channel 310. In some instances, there can be an interference fit between the channel 310 and the base 210 such that the tube spout fitment 200 is held in place while the plate 300 is moved into position. In the alternative, the plate 300 can be located in a generally horizontal orientation, as can be front panel 110 and back panel 120, such that an interference fit between the tube spout fitment 200 and the channel 310 is not required. Upon placement of the front panel 110 over or onto the spout 220, the spout 220 extends through the aperture 118 with the base 210 remaining between the panels 110, 120. Thereafter, the plate 300 can be withdrawn from between the front and back panels 110, 120 while the fitment is left behind in a desired location to be sealed to the pouch 10.

Figure 3A:
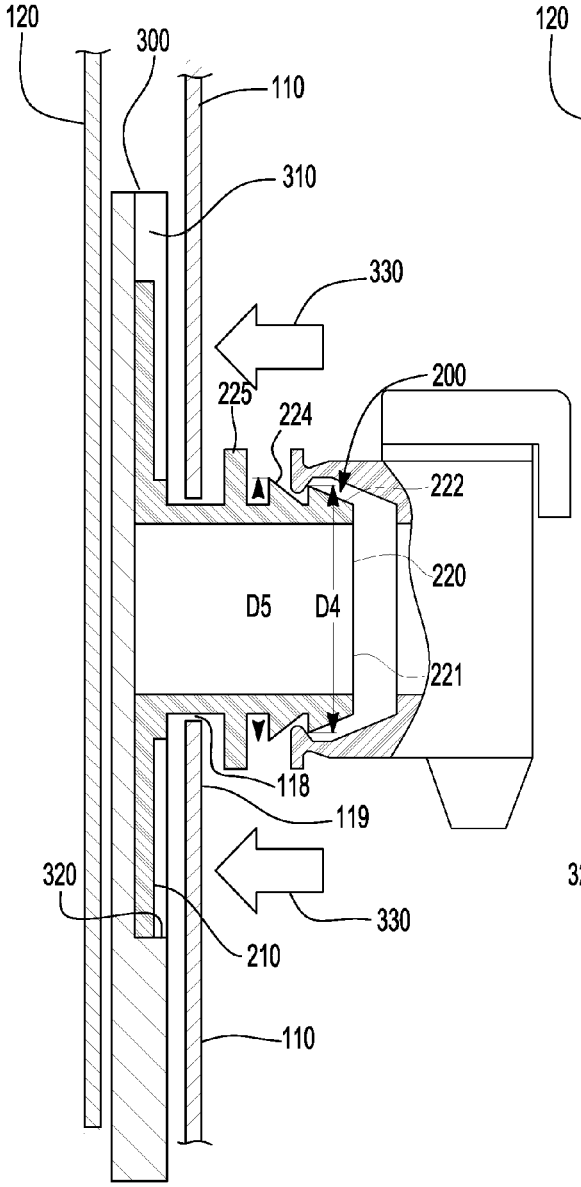
FIG. 3A is a side cross-sectional view of the flexible pouch, tube spout fitment and dispensing cap shown in FIGS. 1 and 2 with a dispensing cap in a first temporary snap position.
Figure 3B:
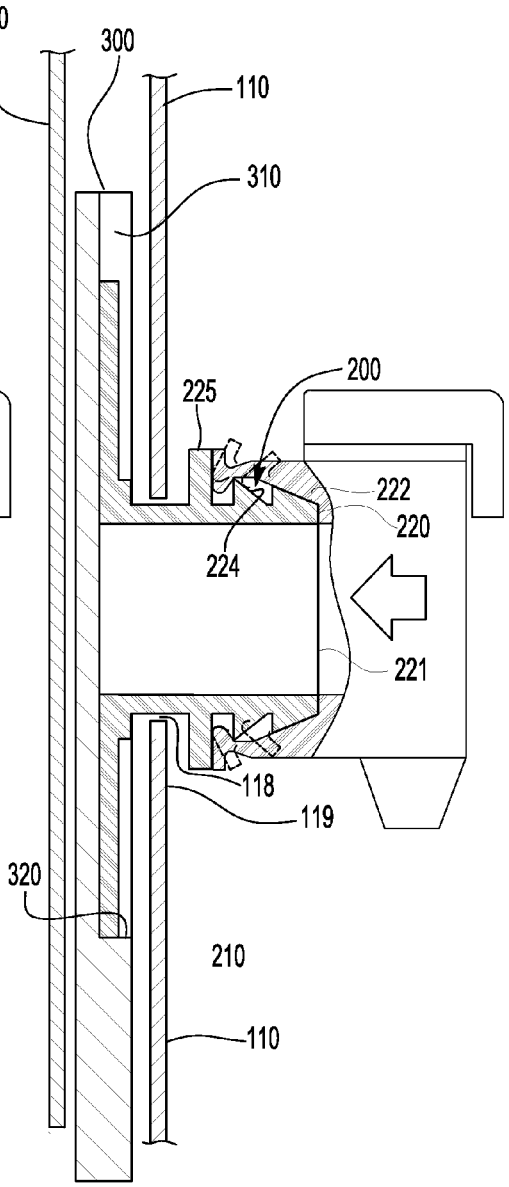
FIG. 3B is a side cross-sectional view of the flexible pouch, tube spout fitment and dispensing cap shown in FIG. 3B with the dispensing cap in a second permanent snap position.

Referring to FIGS. 3A and 3B, a cross-sectional view of the tube spout fitment 200 extending through the aperture 118 of the front panel 110 with the base 210 between the panels 110, 120 is shown. In some instances, the front panel 110 can be pushed over a flange 225 extending from the spout portion 220 as illustrated by the arrows 330. It is appreciated that the diameter of the flange 225 can be larger than the diameter D1 of the aperture 118, but since the panel 110 is made from a flexible and/or pliable material, the panel 110 can be pressed over the flange 225. In this manner, the tube spout fitment 200 can be held in place before the base 210 is actually sealed to the panel. In the alternative, the flange 225 is not present and the panel 110 is sealed to the base 210 with the use or aid of such a flange.

The perimeter 119 and/or a perimeter region adjacent to the aperture 118 can be sealed to the base 210 before or after the plate 300 has been removed from between the panels 110 and 120. As such, the plate 300 can be made from a material durable enough to withstand heat or ultrasonic welding such that it is not sealed to the inner surface of the front panel 110 during sealing of the panel to the base 210. An example of such a material adaptable for such a use includes Teflon®. In the event that the perimeter 119 and/or or a perimeter region adjacent to the aperture 118 is sealed to the base 210 before the plate 300 is removed from between the panels 110 and 120, it is appreciated that the base 210 can have a thickness that is equal to or greater than a depth of the channel 310.

The front panel 110 can be sealed to the base 210 using one or more steps. For example and for illustrative purposes only, a first step can include applying a low melt tack seal as known to those skilled in the art. The low melt tack seal can melt the inner surface of the front panel 110 by subjecting the outer surface of the panel to temperature and pressure such that the tack seal becomes gelatinous. In this manner, the low melt tack seal can spread uniformly along or between the inner surface of the panel 110 and the base 210. Thereafter, a high pressure/high temperature seal can be applied which may or may not be cooled thereafter.

In addition to the tube spout fitment 200, the pouch 10 can have one or more apertures 130, 140 located along a top portion 160. For example and for illustrative purposes only, a generally elongated finger aperture 130 and/or a generally circular finger aperture 140 can be provided. It is appreciated that other shaped apertures can be provided within the scope of the invention. The apertures 130, 140 have a perimeter 132, 142 as shown in the figure and the perimeter may or may not be scalloped-shaped with a plurality of alternating ridges 134, 144 and valleys 136, 146. The scalloped shaped perimeter 132, 142 increases the length and/or surface area of the perimeter edge that will be in contact with an individual's finger or fingers grasping the pouch 10 and thus can reduce pressure on the finger or fingers applied by the flexible pouch container 10 filled with a product.

A dispensing cap 230 can be provided and attached to the fitment 200. It is appreciated that the dispensing cap 230 can provide for opening and closing of the container 10 using any device and/or method known to those skilled in the art. For example, the cap 230 can have a turn tab 234 that affords for a product to flow from the pouch 10 through an end 236. In this manner product can be conveniently dispensed from the pouch 10. In the alternative, the dispensing cap can be a push-pull cap with a push-pull tab that is opened by pulling on the tab and closed by pushing on the tab, or vice versa.

The dispensing cap 230 can have an attachment portion 232 that can fit over the spout 220 of the fitment 200. The spout 220 can have a first circumferential ridge 222 proximate to the distal end 221 and a second circumferential ridge 224 proximate to the base 210. In some instances, a diameter D5 of the second circumferential ridge 224 is greater than a diameter D4 of the first circumferential ridge 222 as illustrated in the figure. The attachment portion 232 can fit over the first circumferential ridge 222 in order to provide a temporary attachment of the cap 230 to the fitment 200 as illustrated in FIG. 3A. The attachment portion 232 can also fit over the second circumferential ridge 224 in order to provide a permanent attachment of the cap 230 to the fitment 200 as illustrated in FIG. 3B. In some instances, the temporary attachment affords for the cap 230 to be removed from the fitment 200 with a minimum amount of force, for example 4 pounds of pulling force. In this manner, the cap 230 can be placed over the fitment 200 and prevent contamination from occurring within the pouch container 10 during storage, shipment, manufacture, and the like, and then removed for filling of the pouch 10 with a product through the fitment 200.

The flexible pouch 10 can be filled through the tube spout fitment 200 before the cap 230 has been attached thereto or in the alternative after the cap 230 has been removed therefrom. Once the pouch 10 has been filled, the cap 230 can be permanently attached to the tube spout fitment 200 by pushing the spout portion 232 over the first circumferential ridge 222 and the larger diameter second circumferential ridge 224 (FIG. 3B). It is appreciated that the permanent attachment of the cap 230 onto the tube spout fitment 200 affords for a gas- and/or liquid-tight seal such that the product does not spill or leak from the pouch 10. Stated differently, by placing or pushing the cap 230 over the second circumferential ridge 224, the cap 230 is permanently attached to the tube spout fitment 200 such that product flows from the pouch 10 only through the use of the cap 230 as known to those skilled in the art. As such, the cap 230 is temporarily or releasably attached to the pouch 10, e.g. for shipping and/or storage, and contamination, dust, etc., is kept out of the interior of the pouch. Then, the pouch 10 is filled with product by removing the cap 230 from the temporary attachment position, and passing the product through the spout 200 and into the pouch 10. Thereafter, the spout 200 is sealed by placing or pushing the cap 230 over the second circumferential ridge 224 of the spout 200, naturally with the cap in a closed position, although this is not required.

Figure 4:
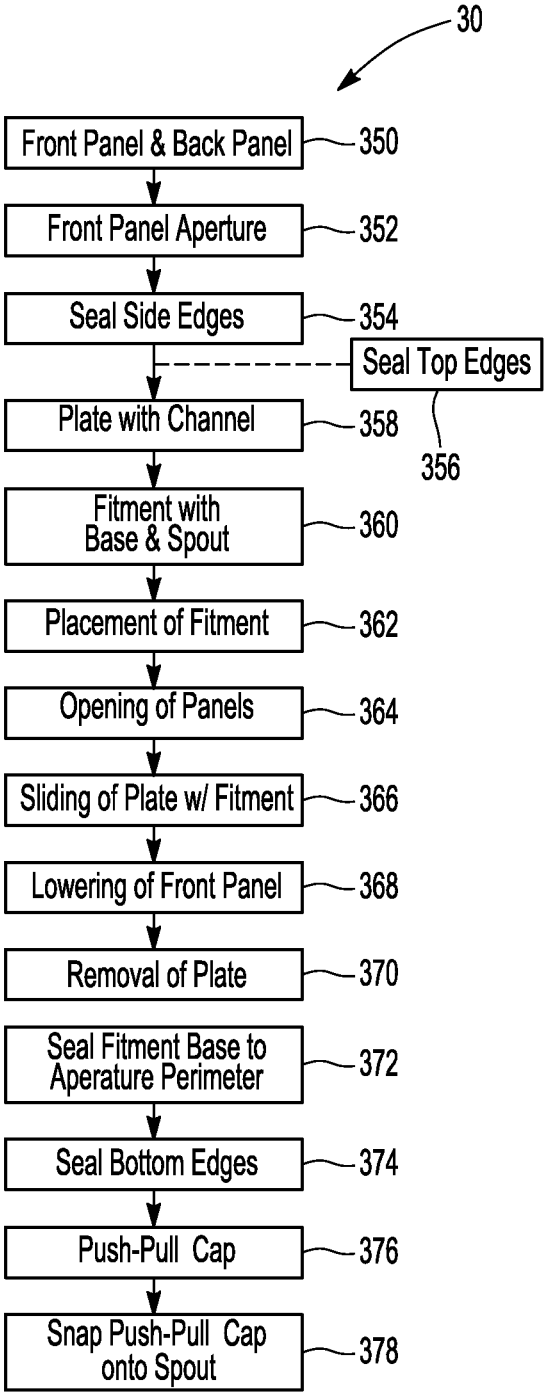
FIG. 4 is a schematic diagram illustrating a process for placing a tube spout fitment within a flexible pouch container according to an embodiment of the present invention.

Turning now to FIG. 4, a process for placing the tube spout fitment within a flexible pouch container is shown generally at reference numeral 30. The process 30 includes providing a front panel and a back panel at step 300 and forming an aperture within the front panel at step 302. As stated above, the front panel and the back panel each have a top edge, a side edge, and a bottom edge, and the side edges of the front and back panels are sealed at step 304. Optionally, the top edges of the front and back panels can be sealed at step 306.

At step 308 a plate with a channel and a channel stop is provided while a fitment with a base and a spout portion is provided at step 310. Thereafter, the fitment and/or fitment base is placed at least partially within the channel of the plate at step 312 such that the fitment base abuts against the channel stop and the front and back panels are opened and/or spaced apart from each other at step 314. The plate with the fitment is slid between the two panels at step 316 and the front panel is placed over the spout of the fitment such that the spout extends through the aperture at step 318.

The plate is removed at step 320 and the fitment base is sealed to the aperture perimeter of the front panel at step 322. In the alternative, the front panel can be sealed to the base of the fitment before the plate is removed. The bottom edges of both panels or the bottom edge of the front panel and a corresponding edge of a gusset are sealed at step 324. The dispensing cap can be provided at step 326 and snapped onto the spout of the fitment at step 328.

It is appreciated that the various steps shown in FIG. 4 can occur at different locations or using a different sequence than as shown in the figure and/or all the steps are not required. In addition, the front panel, the back panel, an optional gusset, the tube spout fitment, and dispensing cap can be made from any material known to those skilled in the art, illustratively including polymers used to handle food products, alcohol products, medical products, industrial products, and the like.

It is also appreciated that the figures and discussion above refer to tube spout fitment located in the center and bottom portion of a panel, however this is not required. For example, the tube spout fitment, and thus the dispensing cap, can be located within a corner region of a flexible pouch and/or top portion or region of a flexible pouch and/or a central portion or region of a flexible pouch. As such, the invention is not restricted to the illustrative examples described above. The examples are not intended as limitations on the scope of the invention. The processes, apparatus, compositions, and the like described herein are exemplary and not intended as limitations on the scope of the invention. Changes herein and other uses will occur to those skilled in the art. The scope of the invention is defined by the scope of the claims.

I claim:

1. A process for filling a flexible pouch with a product, the process comprising:

providing the flexible pouch, the flexible pouch having:

a panel with an aperture; and a spout fitment extending through said aperture, the spout fitment having a base sealed to the panel and a distal end spaced apart from the base;

the spout fitment also having a first circumferential ridge with a first diameter proximate the distal end and a second circumferential ridge with a second diameter proximate the base, the second diameter being larger than the first diameter; and a dispensing cap having an opening for product to flow through, the dispensing cap having a first temporary snap position fitting over the first circumferential ridge and a second permanent snap position fitting over the second circumferential ridge, the dispensing cap attached to the spout fitment over the first circumferential ridge in the first temporary snap position;

removing the dispensing cap in the first temporary snap position from the spot fitment;

filling the flexible pouch with the product through the spout fitment; and re-attaching the dispensing cap onto the spout fitment such that an internal ridge of the dispensing cap is over the second circumferential ridge in the second permanent snap position, the dispensing cap in the second permanent snap position being permanently attached to the spout fitment and providing opening and closing of the flexible pouch for the product to flow from the flexible pouch and through the dispensing cap when the dispensing cap is in an open position and not flow from the flexible pouch when the dispensing cap is in a closed position.

2. The process of claim 1, further including storing the flexible pouch with the dispensing cap in the first temporary snap position for a predetermined amount of time before removing the dispensing cap, filling the flexible pouch with the product through the spout fitment with the dispensing cap removed, re-attaching the dispensing cap onto the spout fitment in the second permanent snap position, the dispensing cap in the second permanent snap position providing the opening of the flexible pouch for the product to flow from the pouch and through the dispensing cap.

3. The process of claim 1, further including shipping the flexible pouch with the dispensing cap in the first temporary snap position from one location to another location before removing the dispensing cap, filling the flexible pouch with the product through the spout fitment with the dispensing cap removed and re-attaching the dispensing cap onto the spout fitment in the second permanent snap position, the dispensing cap in the permanent snap position providing the opening of the flexible pouch for the product to flow from the pouch and through the dispensing cap.

4. The process of claim 1, wherein the dispensing cap has an internal ridge, the internal ridge having the first temporary snap position fitting over the first circumferential ridge and the second permanent snap position fitting over the second circumferential ridge.

5. The process of claim 4, wherein the internal ridge is attached to the spout fitment over the first circumferential ridge in the first temporary snap position.

6. The process of claim 1, wherein the dispensing cap comprises a turn tab for moving the dispensing cap between the open position and the closed position.

7. A process for filling a flexible pouch with a product, the process comprising:

mounting a fitment to a portion of the flexible pouch;

mounting a dispensing cap in a first temporary position onto the fitment for transporting of the pouch, the dispensing cap having an opening for product to flow through;

removing the dispensing cap from the fitment;

filling the flexible pouch with a product through the fitment; and replacing the dispensing cap onto the fitment in a second permanent position and engaging a lock portion of the fitment, the dispensing cap in the second permanent snap position being permanently attached to the spout fitment and providing opening and closing of the flexible pouch for the product to flow from the pouch and through the dispensing cap when the dispensing cap is in an open position and not flow from the flexible pouch when the dispensing cap is in a closed position.

8. The process of claim 7, wherein the fitment has a first circumferential ridge with a first diameter proximate a distal end of the fitment and a second circumferential ridge with a second diameter proximate a base of the fitment, the second diameter being larger than the first diameter.

9. The process of claim 8, wherein the dispensing cap is fitting over the first circumferential ridge while in the first temporary position and is fitting over the second circumferential ridge while in the second permanent position.

10. The process of claim 7, wherein the dispensing cap comprises a turn tab for moving the dispensing cap between the open position and the closed position.

* * * * *